US008202108B2

(12) United States Patent
Shen

(10) Patent No.: US 8,202,108 B2
(45) Date of Patent: Jun. 19, 2012

(54) FPC CONNECTOR WITH BUILT-IN LOCK

(75) Inventor: Guo-Jian Shen, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 111 days.

(21) Appl. No.: 12/765,887

(22) Filed: Apr. 23, 2010

(65) Prior Publication Data

US 2010/0273341 A1 Oct. 28, 2010

(30) Foreign Application Priority Data

Apr. 23, 2009 (CN) ..... 2009 2 0302501

(51) Int. Cl.
*H01R 13/62* (2006.01)

(52) U.S. Cl. ..... 439/329; 439/495

(58) Field of Classification Search ..... 439/260, 439/329, 495

See application file for complete search history.

(56) References Cited

U.S. PATENT DOCUMENTS

| | | | | |
|---|---|---|---|---|
| 6,089,905 | A * | 7/2000 | Shimmyo et al. | 439/495 |
| 6,162,083 | A | 12/2000 | Seto | |
| 6,773,287 | B2 | 8/2004 | Takashita | |
| 7,077,691 | B2 * | 7/2006 | Yokoo et al. | 439/495 |
| 7,083,455 | B1 * | 8/2006 | Miura et al. | 439/260 |
| 7,140,896 | B2 * | 11/2006 | Takai et al. | 439/260 |
| 7,534,131 | B2 * | 5/2009 | Chung | 439/495 |
| 7,695,311 | B2 * | 4/2010 | Nemoto | 439/495 |
| 7,789,698 | B2 * | 9/2010 | Hashimoto et al. | 439/495 |
| 7,887,351 | B2 * | 2/2011 | Wang et al. | 439/260 |

* cited by examiner

*Primary Examiner* — Thanh Tam Le
(74) *Attorney, Agent, or Firm* — Andrew C. Cheng; Wei Te Chung; Ming Chieh Chang

(57) ABSTRACT

An FPC connector (100) includes an insulative housing (1) which has a bottom wall (10) and a pair of end walls (12) thereby forming a mating room (15) with a mating opening (14) located at a front face thereof, a plurality of terminals (2) disposed within the housing and having a contacting portion (210) extending into the mating room and at least one positioning portion (18) substantially located at a corner of the mating opening (14) and partially located upon the bottom wall (10) with a cantilever-shaped configuration.

11 Claims, 7 Drawing Sheets

FPC CONNECTOR WITH BUILT-IN LOCK

BACKGROUND OF THE INVENTION

1. Field of the Invention

The present invention relates to an FPC connector, and more particularly, to an FPC connector with a built-in lock in which an inserted FPC can be securely locked therein and readily disengaged therefrom when needed.

2. Description of the Related Art

FPC is a medium used for data transmission between computers and the peripherals connected thereto. FPC typically has a plurality of conductors for transmitting signal. U.S. Pat. No. 6,162,083 issued to Masashi Seto on Dec. 19, 2000, discloses a conventional electrical connector mounted on a Printed Circuit Board (PCB) for engaging with an FPC. The electrical connector includes an insulative housing, a plurality of conductive terminals retained in the insulative housing across the connector along a width directrion, and an actuator moveably driven between an opened position and a closed position relative to the housing. The insulative housing has a mating space for receiving the FPC therein and a plurality of grooves in communicating with the mating space. Each of the terminals includes a contacting arm electrically connecting with the FPC and a retaining arm corresponding to the contacting arm, both of which extending towards the mating space and creating a gap thicker than a thickness of the FPC at between thereof. By this arrangement, the FPC can be easily inserted therein without any noticeable resistance. The actuator defines a driving portion at middle thereof for urging the FPC against the contacting arm and a pair of bosses detachably connected with the insulative housing at both ends thereof.

When the actuator is set at opened position, the driving portion is away from the mating space and will not exert a biasing force against the FPC inserted into the mating space. When the actuator is rotated and set to the closed position, said driving portion presses against the FPC to engage with the conductive terminal. The insulative housing has a pair of positioning portions integrally extending from both ends thereof for preventing the FPC from being removed away the electrical connector along a mating direction. The positioning portion has a triangle-shaped across section in the mating direction for guiding the insertion and pulling out of the FPC. However the FPC will easily shift upwardly and then readily being pulled away from the electrical connector easily if the actuator is set at opened position, because which is not secured by the positioning portion along a vertical direction perpendicular to the width direction.

Therefore, an improved electrical connector is desired to overcome the disadvantages of the related arts.

SUMMARY OF THE INVENTION

An object of the present invention is to provide an FPC connector overcoming disadvantage of the FPC being easily and accidentally pulled away from the connector.

In order to achieve the above-mentioned object, an electrical connector in accordance with a preferred embodiment of the present invention includes an insulative housing which has a bottom wall and a pair of end walls thereby forming a mating room with a mating opening located at a front face thereof, a plurality of terminals disposed within the housing and having a contacting portion extending into the mating room and at least one positioning portion substantially located at a corner of the mating opening and partially located upon the bottom wall with a cantilever-shaped configuration.

Other objects, advantages and novel features of the invention will become more apparent from the following detailed description of the present embodiment when taken in conjunction with the accompanying drawings.

DETAILED DESCRIPTION OF THE INVENTION

Figure 1:
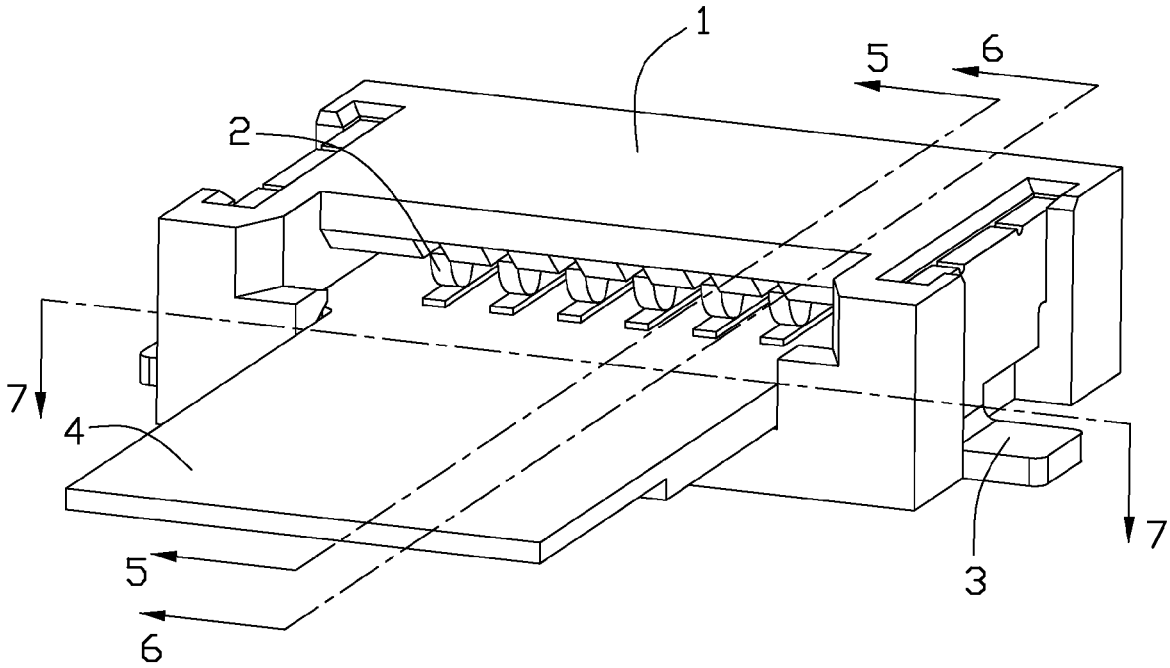
FIG. 1 is a perspective view of an electrical connector engaging with an FPC in accordance with the preferred embodiment of the present invention.

Reference will now be made to the drawing figures to describe the preferred embodiment of the present invention in detail.

Figure 2:
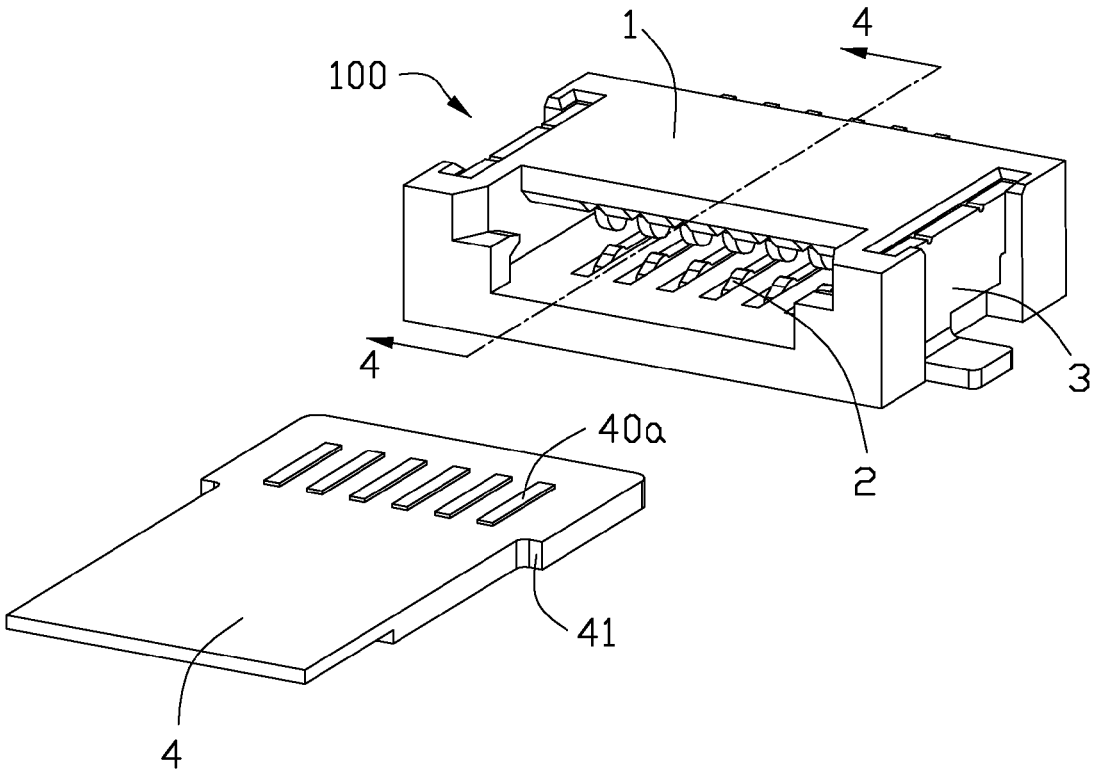
FIG. 2 is a perspective view of the FPC connector disengaging with the FPC of FIG. 1.

Referring to FIGS. 1 and 2, an electrical connector 100 for electrically connecting with a flexible printed circuit board (FPC) 4 includes an insulative housing 1, a plurality of terminals 2 retained in the insulative housing across the electrical connector along a width direction, a pair of metal ears 3 each attached to both ends of the insulative housing.

Figure 3:
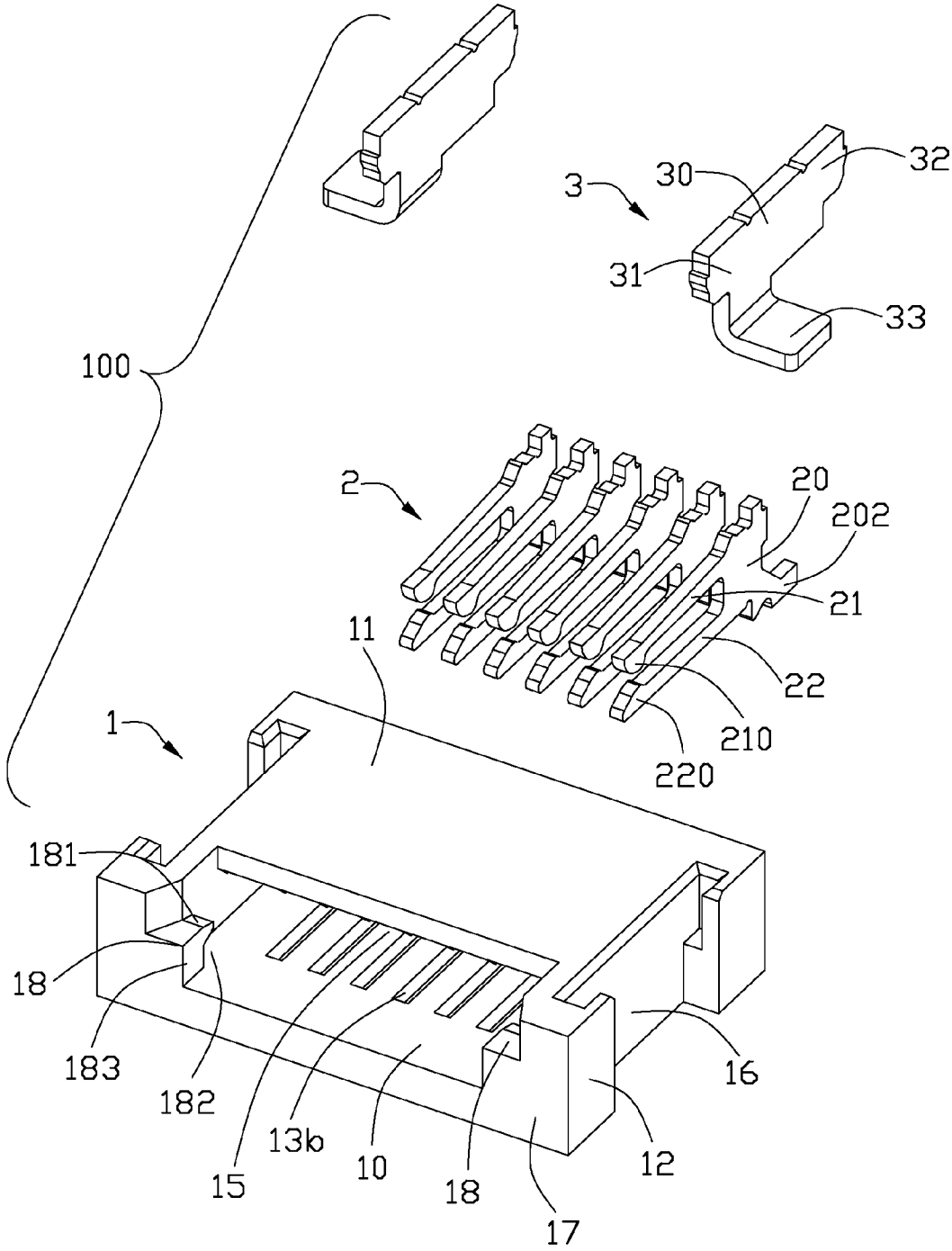
FIG. 3 is an exploded perspective view of the FPC connector of FIG. 2 but not showing the FPC.
Figure 4:
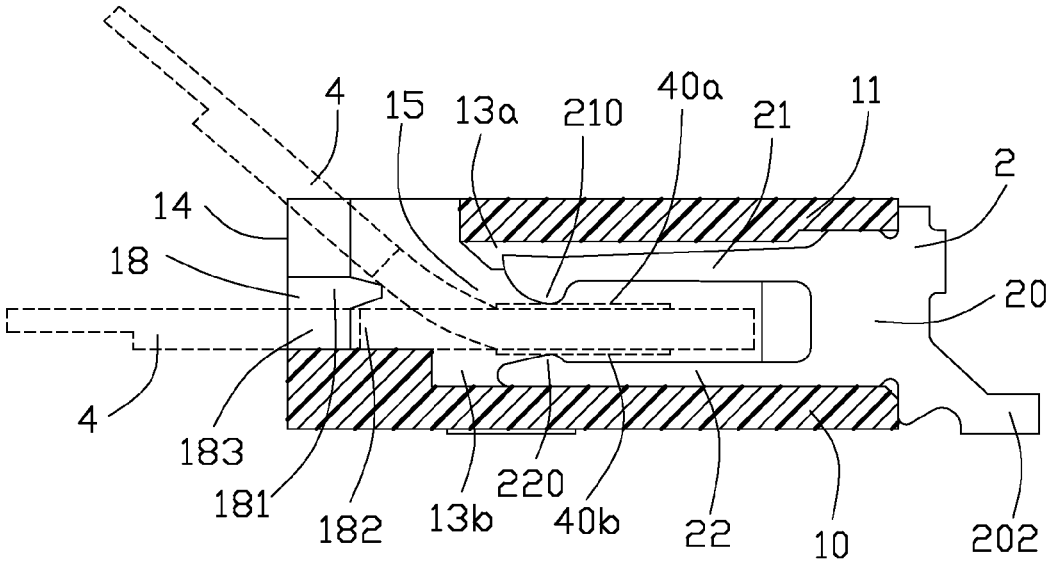
FIG. 4 is a cross-section view of the FPC connector taken along line 4-4 of FIG. 2 with a fictitious inserted FPC.

Referring to FIGS. 3 and 4, the insulative housing 1 has a bottom wall 10, a top wall 11 and a pair of end walls 12 integrally joining said two side walls, thereby forming a mating room 15 with a mating opening 14 located at a front face 17 thereof for receiving the FPC 4 therein. The mating room 15 has a floor formed by the bottom wall 10 and flushed to the mating opening 14 having a width. The insulative housing 1 has a plurality of upper terminal slots 13*a* and lower terminal slots 13*b* separately disposed in the top wall 11 and the bottom wall 10. The end wall 12 has a slot 16 for receiving the metal ear 3.

Figure 5:
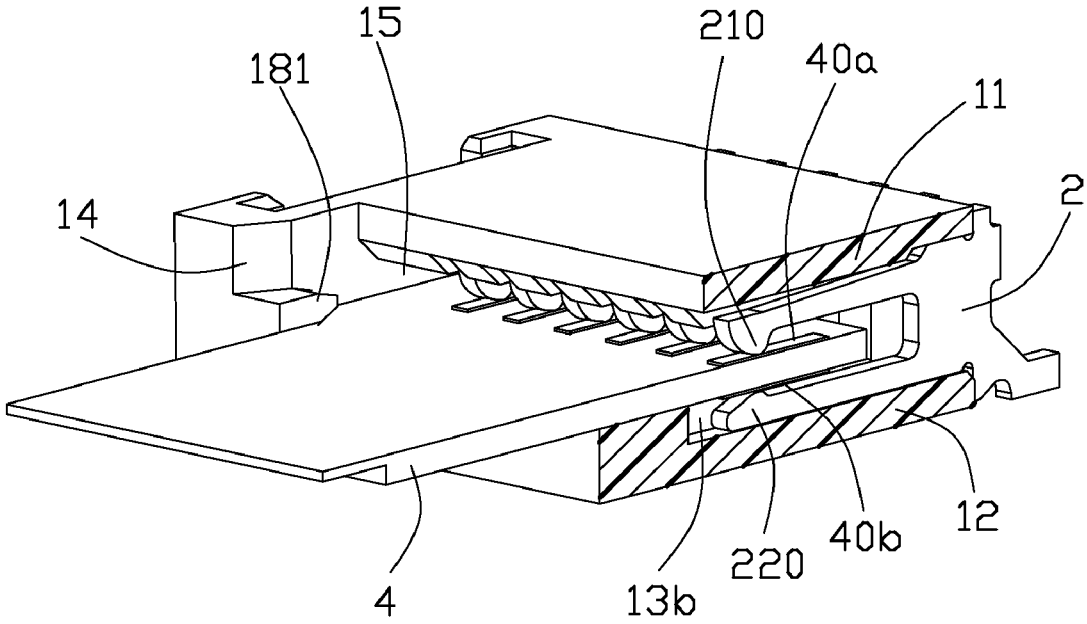
FIG. 5 is a cross-section view of the FPC connector taken along line 5-5 of FIG. 1.
Figure 6:
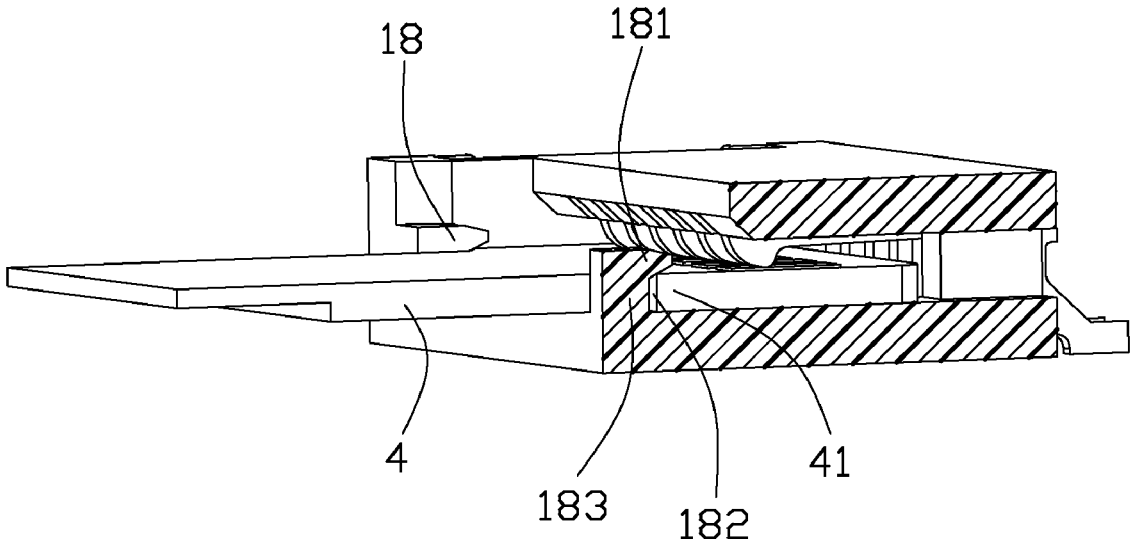
FIG. 6 is a cross-section view of the FPC connector taken along line 6-6 of FIG. 1.
Figure 7:
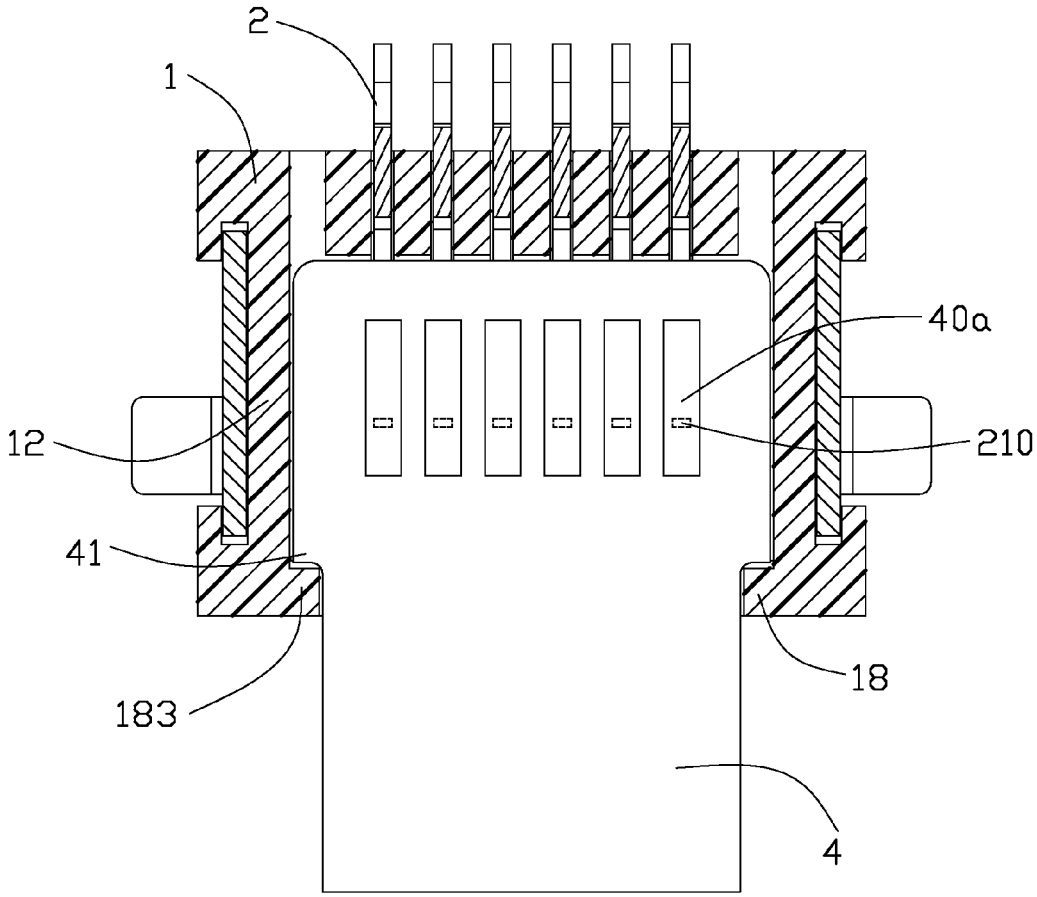
FIG. 7 is a cross-section view of the FPC connector taken along line 7-7 of FIG. 1.

Referring to FIGS. 3, 4 and 5, the terminals 2 are forwardly and respectively inserted into the insulative housing from a rear side of insulative housing 1 opposite to the mating opening 14. Each of the terminals 2 is defined with a body portion 20, an upper arm 21 and a lower arm 22 both extending forwardly from the body portion 20 into the mating room 15. The terminal 2 also forms a soldered portion 202 extending outwardly from the body portion 20 for being soldered onto a Printed Circuit Board (PCB).

The upper arm 21 is attached into the upper terminal slot 13*a* of the top wall 11 and has a first contacting portion 210 at a front end thereof which is closed to the mating opening 14 and protruding into the mating room 15. The first contacting portion 210 is moveably disposed in the terminal slot 13*a*. The lower arm 22 is received in the lower terminal slot 13*b* and includes a second contacting portion 220 at a front end thereof. The second contacting portion 220 is opposite to the first contacting portion 210 thereby creating a gap between the first contacting portions 210 and the second contacting portions 220 for receiving the FPC 4. Because said gap is configured thinner than a thickness of the FPC 4, such that the inserted FPC 4 can be readily inserted into the mating room 15 in a LIF manner and then sandwiched between of said two contacting portions 210, 220. The FPC 4 has a plurality of conductors 40*a*, 40*b* arranged at both sides thereof, separately and electrically connecting with the contacting portions 210, 220 of the terminal 2 for transmitting signal.

Referring to FIGS. 3 to 7, at least one positioning portion 18 separately extending above the bottom wall 10 from a position adjacent to the mating opening 14 and narrowing the mating opening 14 for an-disengagement of the inserted FPC 4. The positioning portion 18 is substantially disposed at a corner of the mating opening 14 and partially located upon the bottom wall 10 with a cantilever-shaped configuration. Furthermore, the positioning portion 18 is located at a corner of the bottom wall 10 and the end wall 12. The positioning portion 18 includes a first positioning section 181 extending substantially parallel to the bottom wall 10 and protruding from an inner side of the end wall 12 towards the mating room 15, and a second positioning section 183 integrally connecting with a front side of the first positioning section 181 and extending from the bottom wall 10 or the end wall 12. So the positioning portion 18 forms an L-shaped configuration (as best seen from FIGS. 4 and 6) and defines a positioning recess 182 opened to the mating room 15.

The FPC 4 is reclined on the positioning portions 18, obliquely inserted into the mating room 15 and then at least partially received in positioning recess 182. The FPC 4 has a shoulder portion 41 engaging with an inner side of the second positioning section 183, and as a result, its forward movement can be properly limited (as best seen from FIGS. 6 and 7). The first positioning section 181 is located upon of the FPC 4 for preventing the FPC 4 from being incidentally pulled away upwardly from the electrical connector. So the FPC 4 is steadily positioned by the L-shaped positioning portions 18 ensuring an electrical connection with the terminals 2 stably.

The metal ear 3 includes a vertical body portion 30 retained in the slot 16, a first retaining portion 31 and a second retaining portion 32 both extending from both ends of the body portion 30 and retained in the end wall 12 and a soldered portion 33 extending outwards from a bottom edge of the body portion 30 for soldered onto a PCB (not shown).

It is to be understood, however, that even though numerous characteristics and advantages of the present invention have been set forth in the foregoing description, together with details of the structure and function of the invention, the dislosure is illustrative only, and changes may be made in detail, especially in matters of shape, size, and arrangement of parts within the principles of the invention to the full extent indicated by the board general meaning of the terms in which the appended claims are expressed.

What is claimed is:

1. An FPC connector, comprising:

an insulative housing comprising a bottom wall and a pair of end walls thereby forming a mating room with a mating opening located at a front face thereof;

a plurality of terminals disposed within the housing and comprising a contacting portion extending into the mating room;

wherein the insulative housing comprises at least one an L-shaped positioning portion substantially located at a corner of the mating opening, the positioning portion is unitarily connecting with the bottom wall and end walls and is distant from the bottom wall;

wherein the insulative housing comprises a positioning recess formed between the positioning portion and the bottom wall and opened to the mating room because of the distance between the positioning portion and the bottom wall; and wherein the positioning portion comprises a first positioning section protruding from the insulative housing and a second positioning section protruding from the bottom wall or the end wall and integrally connecting with a front side of the first positioning section.

2. The FPC connector as described in claim 1, wherein the first positioning section and the second positioning section are both located at the corner formed by the bottom wall and the end wall.

3. The FPC connector as described in claim 2, wherein the first positioning section and the second positioning section form an L-shaped configuration.

4. The FPC connector as described in claim 1, wherein the bottom wall comprises a plurality of terminal slots for receiving a lower arm of the terminal therein.

5. The FPC connector as described in claim 4, wherein the terminal comprises an upper arm opposite to the lower arm and moveably disposed in the top wall of the insulative housing.

6. The FPC connector as described in claim 5, wherein the upper arm and the lower arm of the terminal both defines a contacting portion protruding into the mating room.

7. An FPC connector, comprising:

an insulative housing defining a receiving space with an opening located at a front face thereof, the receiving space having a floor flushed to the opening having a width;

a plurality of contact terminals disposed within the housing and having a contact engaging portion extending the receiving space; and anti disengagement arrangement extending above the floor from a position adjacent to the opening and narrowing the opening, the anti disengagement arrangement and the floor are separate by a positioning recess which is used for receiving an FPC;

wherein the anti-disengagement arrangement includes a projection extending substantially parallel to the floor of the receiving space.

8. The FPC connector as recited in claim 7, wherein the receiving space includes a ceiling with upper passageways defined therein and the contact engaging portions are moveably disposed therein.

9. The FPC connector as recited in claim 8, wherein the floor comprises a plurality of lower passageways corresponding to the upper passageways and with contact retaining portion disposed therein.

10. An FPC (Flexible Printed Circuit) connector for mating with an FPC, comprising:

an insulative housing having a plurality of side walls commonly defining therein a receiving cavity communicating with an exterior through a front opening formed in front face of the housing, said front opening defining an elongated shape for allowing extension of the FPC, one of said side walls defining a cutout around the front face of the housing for allowing movement of said FPC during mating;

a plurality of contacts disposed in the housing with contacting section extending into the receiving cavity;

at least one positioning portion extending inwardly into the receiving cavity from the front face of the housing adjacent to one elongated end of said elongated shape for abutting a step structure formed on the side edge of the FPC so as to hold the FPC in position without withdrawal from the receiving cavity; wherein said positioning portion is unitarily formed with the housing and essentially in an immoveable manner; wherein said positioning portion restricts movement of the FPC in both a front-to-back direction and a vertical direction; and wherein said positioning portion comprises an inward and rearward projection for abutting against an upper side of the FPC to restrict movement of the FPC in the vertical direction.

11. The FPC connector as claimed in claim 10, wherein said one of said side walls where the cutout is formed, is a top side wall of the housing.

* * * * *